US008646211B2

(12) United States Patent
Rosenbeck-Mortensen et al.

(10) Patent No.: US 8,646,211 B2
(45) Date of Patent: Feb. 11, 2014

(54) SLIDING DOOR SYSTEM

(75) Inventors: Peter Rosenbeck-Mortensen, Farum (DK); Thomas Lund, Vedbaek (DK); Joyce Tan, Gilching (DE); Hans Henrik Jochumsen, Allerod (DK)

(73) Assignee: Airbus Operations GmbH, Hamburg (DE)

( * ) Notice: Subject to any disclaimer, the term of this patent is extended or adjusted under 35 U.S.C. 154(b) by 0 days.

(21) Appl. No.: 13/441,569

(22) Filed: Apr. 6, 2012

(65) Prior Publication Data

US 2012/0255229 A1 Oct. 11, 2012

Related U.S. Application Data

(63) Continuation of application No. PCT/EP2010/006113, filed on Oct. 6, 2010.

(60) Provisional application No. 61/248,968, filed on Oct. 6, 2009.

(30) Foreign Application Priority Data

Oct. 6, 2009 (DE) ..... 10 2009 048 388

(51) Int. Cl.
*E05D 15/22* (2006.01)
*E06B 3/50* (2006.01)

(52) U.S. Cl.
USPC ..... 49/404

(58) Field of Classification Search
USPC ..... 49/360, 404, 409
See application file for complete search history.

(56) References Cited

U.S. PATENT DOCUMENTS 3,334,442 A * 8/1967 Boettcher ..... 49/231
3,346,993 A * 10/1967 Johnson ..... 49/409
3,442,051 A * 5/1969 Johnson et al. ..... 49/414
4,090,265 A * 5/1978 Baus ..... 4/607

(Continued)

FOREIGN PATENT DOCUMENTS

EP 0 712 989 A1 5/1996
FR 2 760 779 A1 9/1998

OTHER PUBLICATIONS

English language machine translation for EP 0 712 989 A1, May 22, 1996.

(Continued)

*Primary Examiner* — Katherine Mitchell
*Assistant Examiner* — Justin Rephann
(74) *Attorney, Agent, or Firm* — Krieg DeVault, LLP

(57) ABSTRACT

A sliding door system includes at least one sliding door having an upper and lower sliding-door mount, as well as an upper and lower guide rail for displaceably receiving the upper and lower sliding-door mount, respectively. The guide rails extend parallel to each other and each have a clear inner width that is at least twice as large as the thickness of the sliding door. The upper and lower sliding-door mounts are each at most half as wide as the clear inner width of each guide rail, allowing moving the sliding door into recessed and lifted-out positions, each constituting a stable state. By overcoming a resistance force, the sliding door can be moved between stable states. The sliding door system is lightweight and robust, and enables sliding doors to be displaced freely without a particular sliding door being assigned in a fixed manner to a particular opening to be covered.

25 Claims, 7 Drawing Sheets

(56) References Cited

U.S. PATENT DOCUMENTS

| | | | | |
|---|---|---|---|---|
| 4,575,966 | A | 3/1986 | Gerritsen | |
| 4,606,081 | A * | 8/1986 | Baus | 4/557 |
| 4,703,586 | A * | 11/1987 | Smith et al. | 49/307 |
| 4,752,106 | A | 6/1988 | Salvarani | |
| 5,513,469 | A * | 5/1996 | Tajudeen et al. | 49/404 |
| 5,630,294 | A * | 5/1997 | Bruno | 49/209 |
| 5,632,119 | A * | 5/1997 | Bruno | 49/209 |
| 6,415,550 | B1 * | 7/2002 | Fin | 49/442 |
| 7,845,116 | B2 * | 12/2010 | Masuda | 49/223 |
| 8,051,536 | B2 * | 11/2011 | Konecek-Hughes | 16/96 R |
| 2007/0119548 | A1 * | 5/2007 | Anderson | 160/211 |
| 2008/0100152 | A1 * | 5/2008 | Busch | 310/14 |
| 2008/0209813 | A1 * | 9/2008 | Haab et al. | 49/360 |
| 2009/0044916 | A1 * | 2/2009 | Singiser et al. | 160/201 |

OTHER PUBLICATIONS

English language machine translaction for FR 2 760 779 A1, Sep. 18, 1998.

* cited by examiner a)

b)

SLIDING DOOR SYSTEM

The present application is a continuation of International Patent Application No. PCT/EP2010/006113, filed Oct. 6, 2010, which claims the benefit of U.S. Provisional Application No. 61/248,968, filed Oct. 6, 2009 and claims priority to German Patent Application No. 10 2009 048 388.8, filed Oct. 6, 2009, each of which is incorporated herein by reference.

The invention relates to a sliding door system comprising at least a first sliding door, which is designed to be disposed in front of an opening to be covered by the sliding door and which has an upper sliding-door mount and a lower sliding-door mount, and comprising an upper guide rail for receiving the upper sliding-door mount in a displaceable manner and a lower guide rail for receiving the lower sliding-door mount in a displaceable manner, the two guide rails extending parallel to each other in the longitudinal direction and parallel to the opening to be covered. Each sliding-door mount can be realized as a separate part connected to the sliding door, but it can also be integrated into the sliding door and constituted, for example, merely by the upper and the lower edge of the sliding door.

Sliding door systems having doors that can be displaced and lifted out are known in the art. In the case of such known sliding door systems, however, there is the problem that the door mechanism used does not afford complete freeing of the opening to be closed over by the sliding door and/or the sliding door can only be lifted out at particular displacement positions.

The invention is based on the object of providing an improved sliding door system that is more lightweight and less mechanically complicated than conventional sliding door systems and that is therefore particularly well suited for use in an aircraft, in particular in the galley region of an aircraft.

This object is achieved, according to the invention, by a sliding door system having the features of claim 1. Accordingly, each guide rail has a clear inner width that is at least twice as large as the thickness of the sliding door. Further, the upper sliding-door mount and the lower sliding-door mount are each at most half as wide as the clear inner width of each guide rail, such that each sliding door can be moved, perpendicularly in relation to the plane of the opening to be covered, into a recessed position located closer to the opening and into a lifted-out position at a greater distance from the opening. The recessed position and the lifted-out position each define a stable state of the sliding door, from which the sliding door can be moved into the respectively other stable state after a defined resistance force acting transversely in relation to the direction of displacement has been overcome.

The sliding door system according to the invention has a number of advantages: there is no mechanical coupling of a sliding door to a particular opening to be covered but, rather, the upper guide rail and the lower guide rail, which can extend along a row of openings to be covered that are disposed next to each other, constitute the only mechanical coupling points to the sliding door or the sliding doors. It is possible for each sliding door of the sliding door system according to the invention to be displaced, in principle, both in the recessed position and in the lifted-out position if, at the time of a desired displacement, there is sufficient space in the direction of displacement. Owing to the defined resistance force acting transversely in relation to the direction of displacement, each sliding door is bi-stable, i.e. it can assume a stable state in the recessed position and in the lifted-out position, whereas long-lasting intermediate positions are prevented. Since the type of mechanical connection is less complicated in the case of the sliding door system according to the invention, the overall weight is reduced considerably while, at the same time, the operational safety is increased, which is very advantageous, particularly for use of such a sliding door system in an aircraft. In addition, the sliding door system according to the invention has a very tidy, and therefore elegant, appearance.

According to a first embodiment of the sliding door system according to the invention, the defined resistance force acting transversely in relation to the direction of displacement is generated in that a row of first magnets is disposed, respectively, along the center line of the lower guide rail and of the upper guide rail, and a row of second magnets is disposed, respectively, in the lower sliding-door mount and in the upper sliding-door mount, such that repelling forces act between the row of first magnets and the row of second magnets. Because the first magnets are disposed centrally in the lower and upper guide rail, these repelling forces are then greatest when a sliding door is located exactly between its two stable states. Thus, when being moved from the one stable state, e.g. the recessed position, after the resistance force caused by the repelling forces acting between the magnets has been overcome, the sliding door virtually snaps into the other stable state, in this case into the lifted-out position, and is forced by the said repelling forces into the respective stable state. In this case, however, the repelling forces acting in the stable state are not so great that they perceptibly impede sliding of the sliding door.

According to another embodiment of the sliding door system according to the invention, the defined resistance force acting transversely in relation to the direction of displacement is caused in that a row of first magnets is disposed along the center line of the lower guide rail, and a row of second magnets is disposed in the lower sliding-door mount, such that repelling forces act between the row of first magnets and the row of second magnets, and in that along the upper guide rail, a first row of third magnets is disposed at locations that are adjacent to the upper sliding-door mount when the sliding door is in the recessed position, and a second row of third magnets is disposed at locations that are adjacent to the upper sliding-door mount when the sliding door is in the lifted-out position, and a row of second magnets is disposed in the upper sliding-door mount, such that forces of attraction act between the rows of third magnets and the row of second magnets.

In the case of the aforementioned embodiment, the functioning of the first and second magnets is as described in the case of the first embodiment, whereas, in the region of the upper sliding-door mount and the upper guide rail, the two rows of third magnets generate magnetic forces of attraction whose action is particularly strong in the two stable states of the sliding door, i.e. in the recessed position and in the lifted-out position of the sliding door. These forces of attraction assist in moving a sliding door from its one stable state into the other stable state, in that they tend to raise somewhat the sliding door concerned, thereby reducing the friction, particularly between the lower sliding-door mount and the lower guide rail, and facilitating the movement mentioned. In addition, these forces of attraction provide a particularly distinct bi-stable state, because they are strongest in the two stable states of the sliding door.

According to a third embodiment of the sliding door system according to the invention, the defined resistance force acting transversely in relation to the direction of displacement is caused in that a first row of first magnets is disposed, respectively, along the lower guide rail and the upper guide rail, at locations that are adjacent to the lower sliding-door mount and the upper sliding-door mount, respectively, when the sliding door is in the recessed position, and a second row of first magnets is disposed, respectively, at locations that are adjacent to the lower sliding-door mount and the upper sliding-door mount, respectively, when the sliding door is in the lifted-out position, and in that a row of second magnets is disposed, respectively, both in the lower sliding-door mount and the upper sliding-door mount, such that forces of attraction act between the rows of first magnets and the row of second magnets.

The functioning principle that was used only in respect of the upper guide rail in the case of the second embodiment is also applied, in this third embodiment, in the case of the lower guide rail. Unlike the first embodiment, in which the defined resistance force acting transversely in relation to the direction of displacement is greatest in the center, between the two stable states of a sliding door, in the case of this third embodiment this resistance force assumes its maximum in the two stable states themselves.

In the case of the three aforementioned embodiments of the sliding door system according to the invention, the magnets can be permanent magnets. The permanent magnets can be realized as bar magnets and can be disposed, transversely in relation to the extent of the respective guide rail, in or on the latter, such that, for example, their minus pole is located in the region of the center of the guide rail. The associated plus pole of a magnet is then disposed in the edge region of the guide rail. In the case of the selected example, however, permanent magnets realized as bar magnets are disposed in the sliding-door mounts such that their minus poles face downwards or upwards, i.e. towards the minus poles in the guide rails. If the permanent magnets disposed in the guide rails are disposed such that the plus poles face alternately to the left and to the right, then, in addition to the repelling forces produced in the central position between the stable states, it is also possible to use forces of attraction that act in the two stable end positions of the sliding door.

Instead of permanent magnets, electrically controlled coil magnets can also be used. Such coil magnets offer the advantage that their polarity can be reversed by reversal of the current flowing through them.

The upper guide rail and/or the lower guide rail are/is preferably U-shaped in cross-section. This makes it possible for the magnets, in particular the coil magnets, to be disposed in or on the limbs of the U-shaped cross-section. According to a preferred embodiment of the sliding door system according to the invention, the lower guide rail and the upper guide rail have a U-shaped cross-section, having two limbs, of which one limb is adjacent to the plane of the opening to be covered, and one limb is at a greater distance from the plane of the opening to be covered. The first row of first magnets is disposed along the limb that is adjacent to the plane of the opening to be covered. The second row of first magnets is disposed along the limb that is at a greater distance from the plane of the opening to be covered. In the case of this embodiment, the first magnets are electrically controlled coil magnets that are reversible in their polarity, such that the sliding door can be moved, e.g. from the recessed position into the lifted-out position and back, through corresponding electrical control of the coil magnets. This is easily achieved in that the first magnets are controlled such that repelling forces act between the first row of first magnets in the guide rail and the row of second magnets in the sliding-door mount, and forces of attraction act between the second row of first magnets in the guide rail and the row of second magnets in the sliding-door mount (movement of the sliding door from the recessed position into the lifted-out position), or are controlled such that repelling forces act between the second row of first magnets (in the guide rail) and the row of second magnets (in the sliding-door mount), and forces of attraction act between the first row of first magnets and the row of second magnets (movement of the sliding door from the lifted-out position into the recessed position).

According to a fourth embodiment of the sliding door system according to the invention, the defined resistance force acting transversely in relation to the direction of displacement is generated mechanically. For this purpose, for example, extending along the center line of the lower guide rail and/or of the upper guide rail there can be a mechanical resistance that must be overcome when the sliding door or a sliding door is being moved from the recessed position into the lifted-out position and vice versa. In the case of one exemplary embodiment, this mechanical resistance is constituted by a longitudinal rib. Advantageously, in the case of such an exemplary embodiment, the upper sliding-door mount and the lower sliding-door mount are each provided with a row of resiliently mounted rolling or sliding elements, which produce a rolling or sliding contact between the upper sliding-door mount and the upper guide rail, on the one hand, and the lower sliding-door mount and the lower guide rail, on the other hand. Advantageously, balls can be used as rolling elements. Other resilient elements can also be used in the upper and lower sliding-door mount if it is ensured that, when the sliding door is being moved from the first stable state into the other stable state, these elements can be moved over the longitudinal rib constituting the mechanical resistance.

Alternatively, the longitudinal rib can be resiliently biased into a position projecting out of the associated guide rail. In the case of this embodiment, when the sliding door is being moved from the first stable state into the second stable state, against the resilient biasing, the longitudinal rib moves into the guide rail and thereby creates the mechanical resistance.

In the case of all embodiments of the sliding door system according to the invention, a plurality of openings to be covered preferably are disposed next to each other in a row, and the upper guide rail and the lower guide rail each extend over the entire length of all openings to be covered, a plurality of sliding doors for covering a plurality of openings or all openings being received in a displaceable manner in the guide rails. A great advantage of the sliding door system according to the invention in this case consists in that each sliding door can be displaced freely along the entire extent of the upper and lower guide rails, such that any sliding door can be used to cover a particular opening. The displacement movement of each sliding door can be a sliding operation or a rolling operation, depending on design of the sliding door.

In the case of embodiments having a plurality of openings disposed next to each other, the upper guide rail and the lower guide rail can be realized as a single piece but, advantageously, the upper guide rail and the lower guide rail are each composed of a plurality of guide rail portions that adjoin each other.

Further, in the case of a preferred embodiment of the sliding door system according to the invention, each sliding door can be locked in its recessed position. By means of such locking, it can be ensured, for example, that each sliding door reliably retains its recessed position, even under adverse conditions, for instance the occurrence of strong forces, such as those that can be caused by air turbulence during flight, that act upon the sliding doors.

An exemplary embodiment of the invention is explained more fully in the following with reference to the appended, schematic figures, wherein:

FIG. 1 shows an exemplary embodiment of a sliding door system in cross-section, a sliding door being represented in FIG. 1 both in a recessed position and in a lifted-out position, FIG. 2 shows a schematic representation of the lower region of the sliding door system represented in FIG. 1, to better explain the functioning thereof, FIG. 3 shows the characteristic of a magnetic resistance force as the sliding door of the sliding door system is displaced from the recessed position into the lifted-out position, or vice versa, and FIG. 4 shows a three-dimensional view of the upper part of a sliding door, as can be used in the sliding door system according to the invention.

Figure 1:
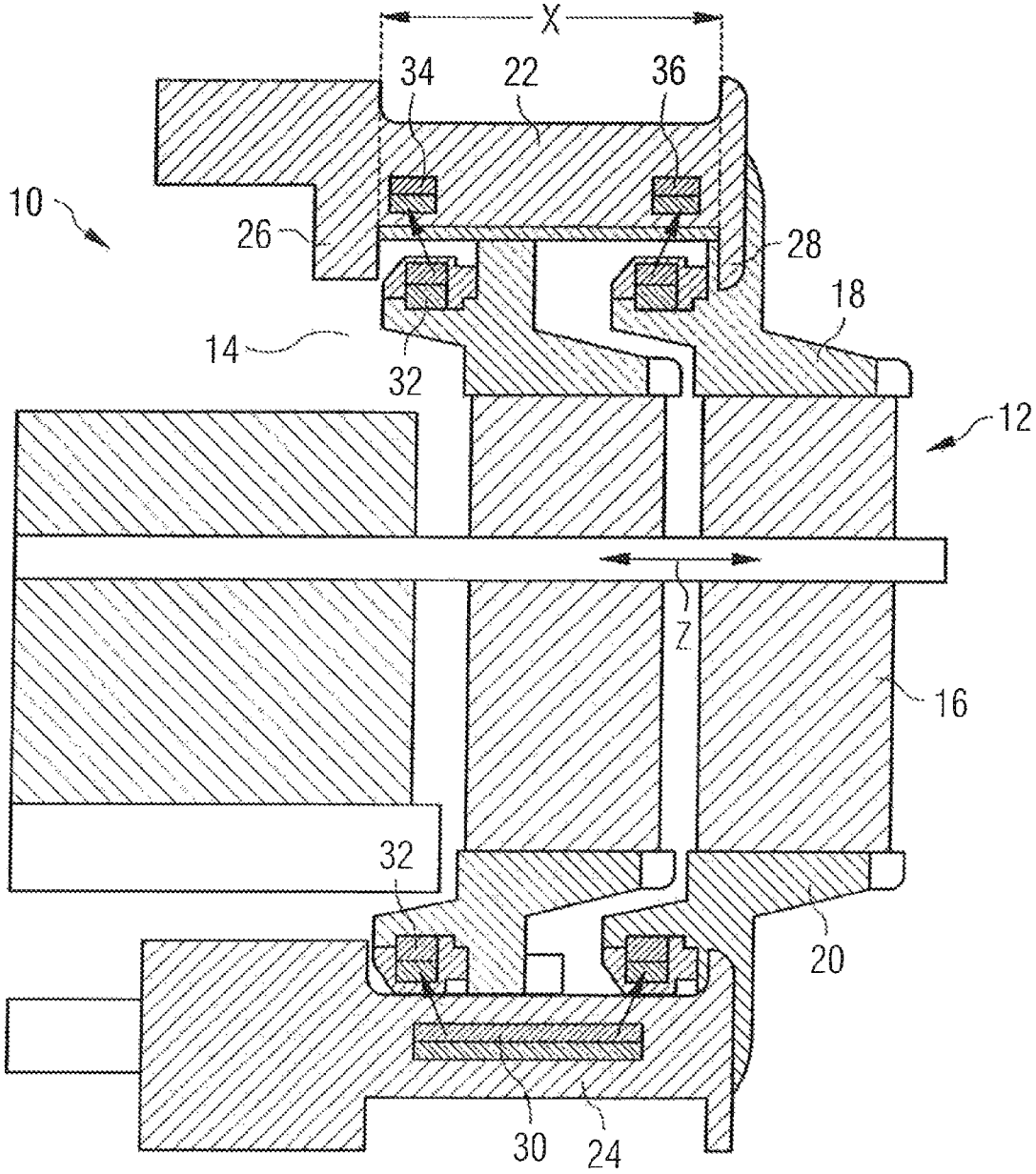

An exemplary embodiment of a sliding door system, denoted in general by 10, is shown schematically in FIG. 1, with only the upper and lower region that are relevant to the functioning of the system being represented in the figure, whereas the central portion has been omitted.

The sliding door system 10 has at least one sliding door 12, which is intended, depending on its displacement position, to cover or close over an opening 14. The opening 14 can be, for example, the front opening of a cabinet compartment or similar.

The sliding door 12 comprises a door leaf 16, to which an upper sliding-door mount 18 and a lower sliding-door mount 20 are fastened. In order that the sliding door 12 can be displaced along the direction of displacement (in FIG. 1, this direction of displacement runs perpendicularly to the plane of the paper), the upper sliding-door mount 18 is received in an upper guide rail 22 and the lower sliding-door mount 20 is received in a lower guide rail 24. In the exemplary embodiment represented, both guide rails 22, 24 have a substantially U-shaped cross-section, having limbs that serve for lateral guidance, of which one limb 26 is adjacent to the plane of the opening 14 to be covered, while the other limb 28 is at a greater distance from the opening 14 to be covered. The guide rails 22, 24 run parallel to each other and parallel to the opening 14.

The sliding door 12, or each sliding door, of the sliding door system 10 can be displaced, not only in the said direction, but also in a direction perpendicular to the plane of the opening to be covered, from a recessed position located closer to the opening 14 into a lifted-out position at a greater distance from the opening, and back, as symbolized by the double arrow Z in FIG. 1. In this case, the sliding door 12 shown on the right in FIG. 1 represents the lifted-out position, while the sliding door 12 shown on the left in FIG. 1 represents the recessed position.

To enable the sliding door 12 to be moved from the recessed position into the lifted-out position and back, each guide rail 22, 24 has a clear inner width x that is at least twice as great as the thickness of the sliding door 12 or, more precisely, of its door leaf 16. Further, each sliding-door mount 18, 20 is at most half as wide as the clear inner width x of each guide rail 22, 24.

When the sliding door 12 is being moved from the recessed position into the lifted-out position and back, a defined resistance force, acting transversely in relation to the direction of displacement of the sliding door, must be overcome, which resistance force results in the recessed position of the sliding door 12 and the lifted-out position of the sliding door 12 each constituting a stable state, in which the sliding door 12 remains if there are no sufficient forces acting upon it to overcome the defined resistance force.

Figure 2:
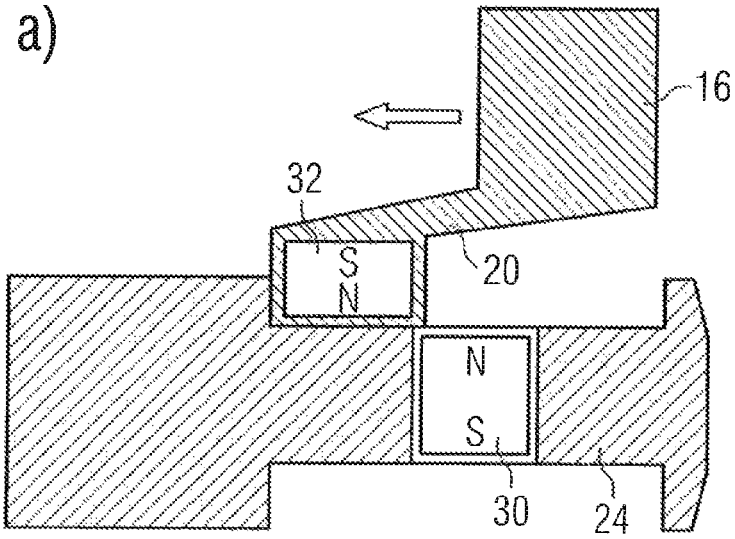
Figure 2:
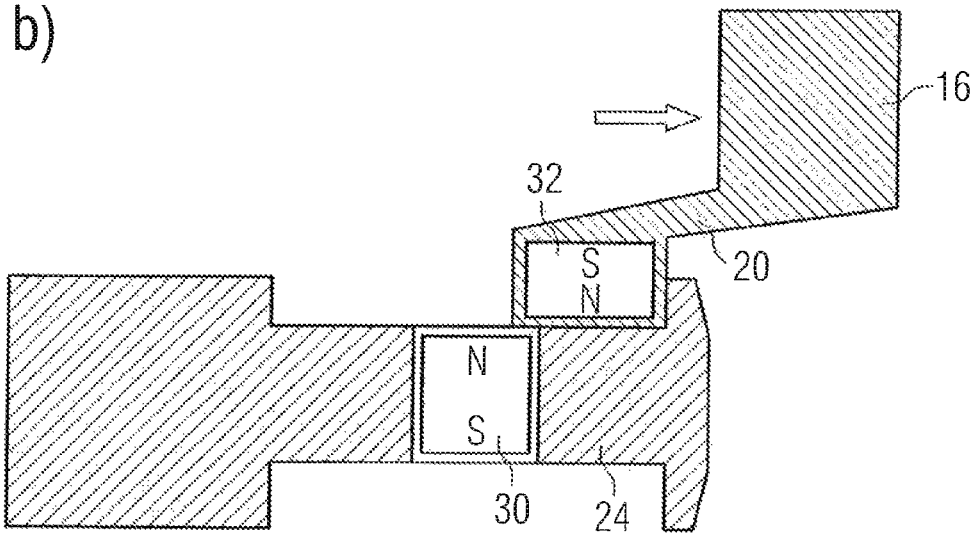

In the case of the exemplary embodiment represented in FIG. 1, this resistance force is a magnetic resistance force. For the purpose of generating this magnetic resistance force, a row of first magnets 30 is disposed along the center line of the lower guide rail 24, and a row of second magnets 32 is disposed in the lower sliding-door mount 20, such that repelling forces act between the row of first magnets 30 and the row of second magnets 32, i.e. the individual magnets 30 and 32 are disposed such that magnetic poles that are of the same kind, and that therefore repel one other, face towards each other (see also FIG. 2). When the sliding door 12 is being moved in the Z direction, the characteristic of the magnetic resistance force represented in FIG. 3 thus ensues, said resistance force having its maximum exactly in the center of the displacement path x, since it is there that the mutually facing, like poles of the first magnets 30 and of the second magnets 32 are exactly opposite each other. Towards the recessed position (FIG. 2*a*) and also towards the lifted-out position (FIG. 2*b*), the magnetic resistance force decreases continuously and can even change into a slight force of attraction, particularly when the unlike pole of the first magnets 30 is located to the left or right of the center line of the lower guide rail 24.

Along the upper guide rail 22, in the exemplary embodiment shown, a first row of third magnets 34 is disposed at a location that is adjacent to the upper sliding-door mount 18, e.g. is substantially opposite the latter when the sliding door 12 is in its recessed position. A second row of third magnets 36 is disposed in the upper guide rail 22, at a location that is adjacent to the upper sliding-door mount 18, e.g. is substantially opposite the latter when the sliding door 12 is in its lifted-out position. For the purpose of acting together with the first row of third magnets 34 and with the second row of third magnets 36, a further row of second magnets 32 is disposed in the upper sliding-door mount 18, such that forces of attraction act between the rows of third magnets 34, 36 and the row of second magnets 32, i.e. the second magnets 32 are disposed such that their one magnetic pole faces towards the unlike pole of the third magnets 34, 36.

Figure 3:
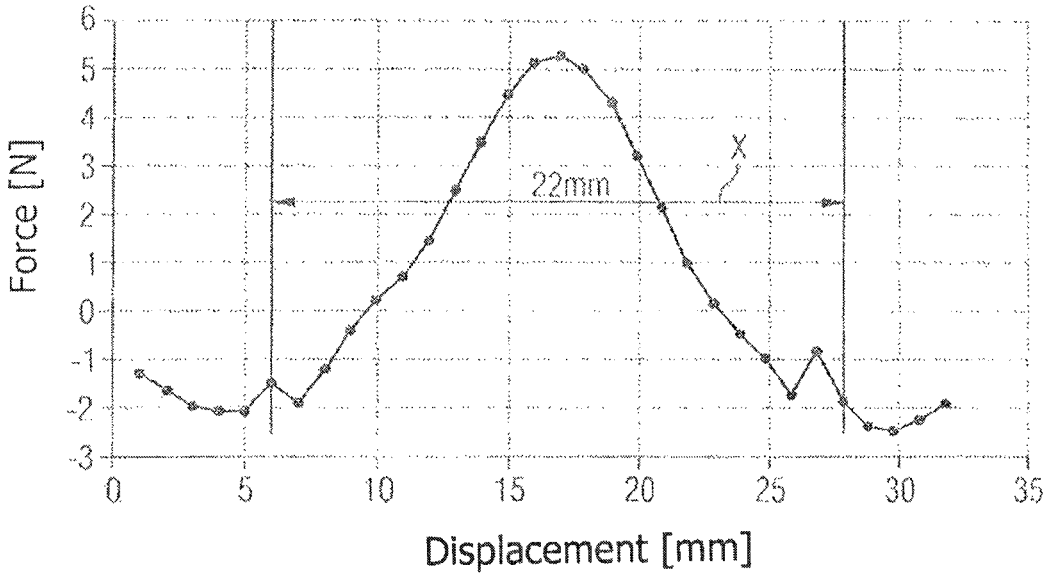

When the sliding door 12 is in the recessed position and in the lifted-out position, therefore, forces of attraction act between, respectively, the first row of third magnets 34 and the second magnets 32 disposed in the upper sliding-door mount 18, and between the latter magnets and the second row of third magnets 36, which forces of attraction must be overcome when the sliding door 12 is being moved from the recessed position into the lifted-out position and back, and which are superposed on the magnetic resistance force according to FIG. 3. On the other hand, these forces of attraction seek to lift the sliding door 12 somewhat out of the lower guide rail 24, this reducing the friction of the lower sliding-door mount 20 in the lower guide rail 24 and making it easier to move the sliding door 12, both in the direction of displacement and in the Z direction.

The magnets 30, 32, 34 and 36 can be realized as permanent magnets, or they can be electrically controlled coil magnets. Combinations of both magnet types are also conceivable, for example the magnets located in the sliding-door mounts 18, 20 can be permanent magnets, while the magnets located in the guide rails 22, 24 are coil magnets than can be controlled electrically.

Figure 4:
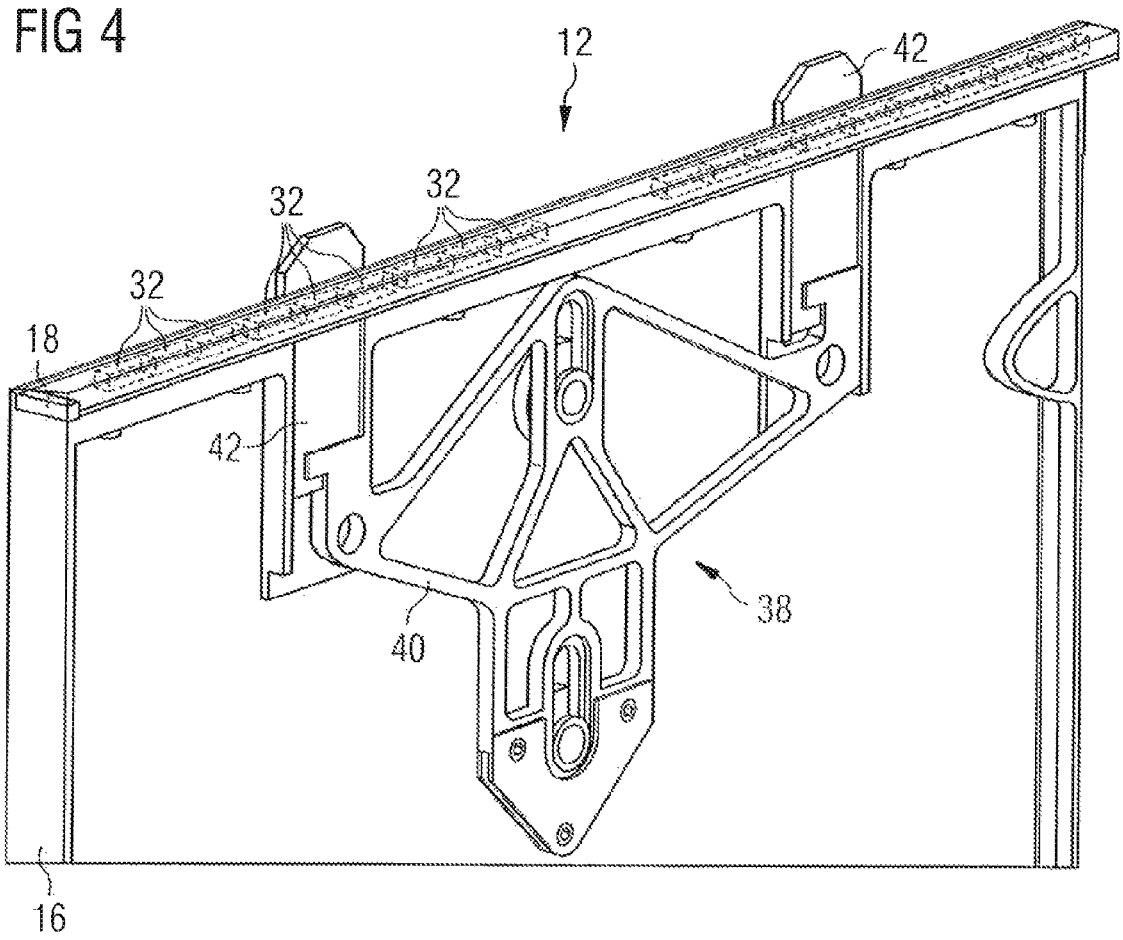
Figure 5:
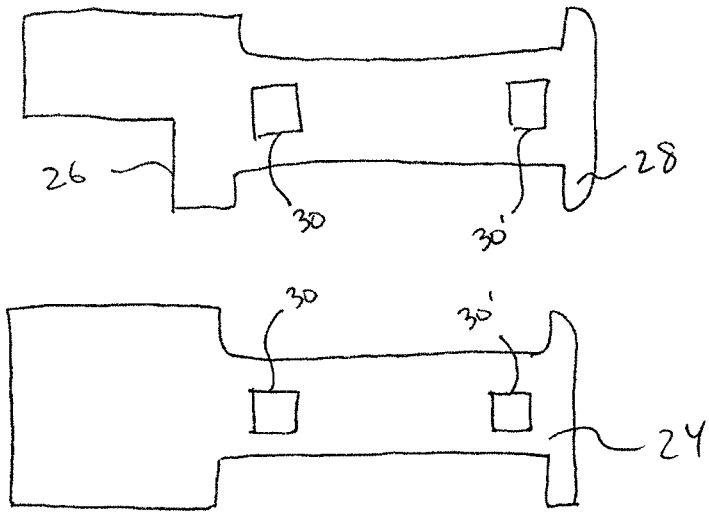
FIG. 5 shows an embodiment in which a first row of magnets and a second row of magnets are located in the upper and lower guide rails.
Figure 6:
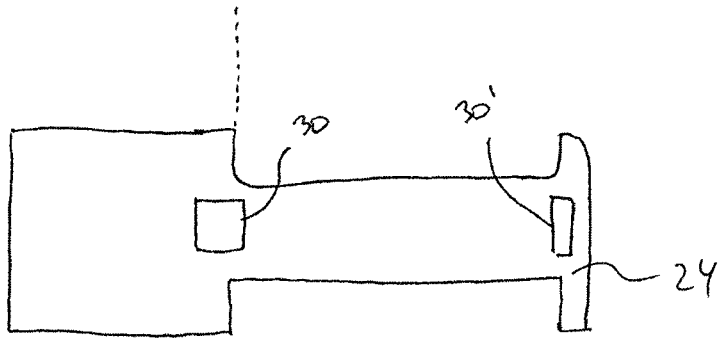
FIG. 6 shows an embodiment in which a first row of first magnets is disposed adjacent to a plane of opening to be covered, and a second row of first magnets disposed along the limb that is at a greater distance from the plane of opening to be covered.
Figure 7:
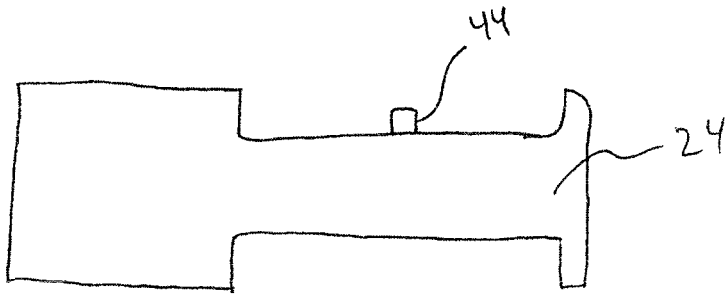
FIG. 7 shows an embodiment in which a rib is disposed with a guide rail.
Figure 8:
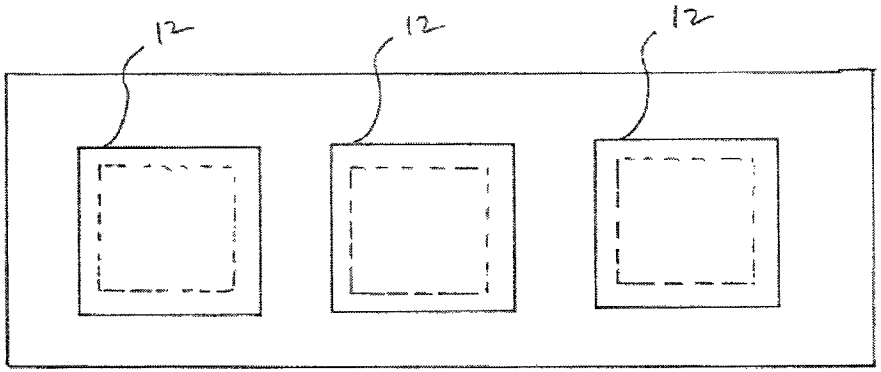
FIG. 8 shows an embodiment in which doors cover respective openings.
Figure 9:
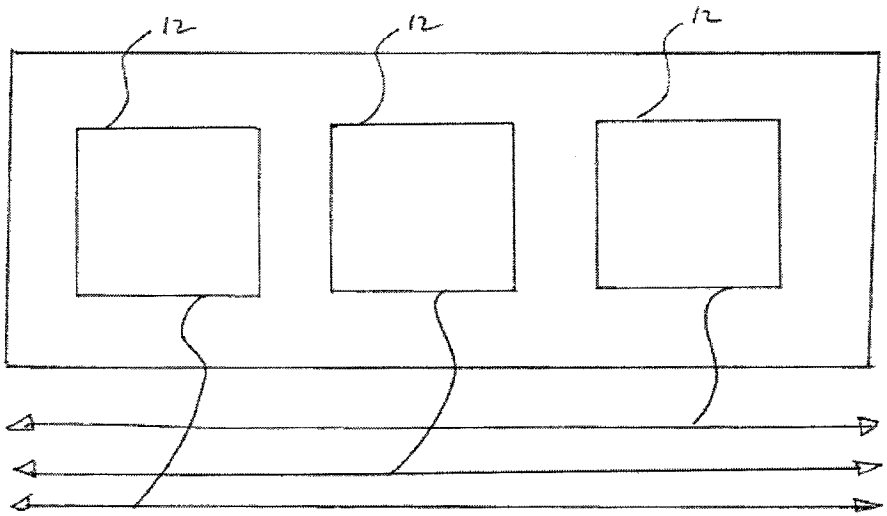
FIG. 9 shows an embodiment in which doors are adapted to be displaced freely along the entire extent of the upper and lower guide rails.
Figure 10:
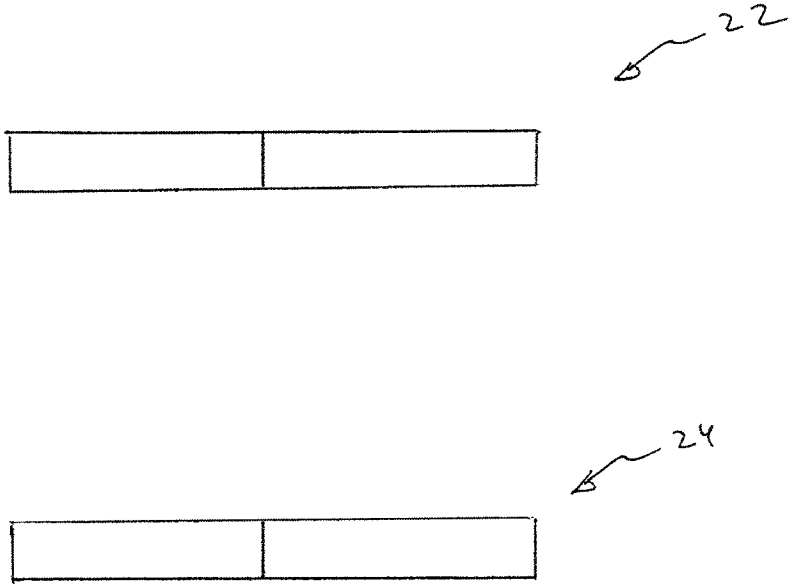
FIG. 10 shows an embodiment have multiple upper and lower guide rails.

FIG. 4 shows a perspective representation of the upper region of a sliding door 12 with the upper sliding-door mount 18, in which the second magnets 32 are disposed in groups of three magnets in each case, each having the same alignment. In this exemplary embodiment, there is a total of 36 second magnets 32 in the upper sliding-door mount 18, but the number of second magnets 32 depends on the size and weight of the sliding door 12 and is selected, depending on the particular application, such that appropriate repelling forces and/or forces of attraction are obtained.

Also shown in FIG. 4 is a door locking mechanism, denoted in general by 38, which consists substantially of a frame or base body 40 that is mounted in a displaceable manner in the plane of the door and fastened to which there are two locking catches 42, which can engage, through the upper sliding-door mount 18 or past the latter, in slots, not represented, that are realized in the upper guide rail 22. When the locking catches 42 are extended, i.e. when they engage in the said slots, the sliding door 12 is locked against unintentional opening, whereas, when the locking catches 42 are in the retracted state, it is free to be displaced in the direction of displacement and to be moved in the Z direction. A door locking mechanism 38 of the same type can also be provided in the lower part of the sliding door 12, and act together with the lower guide rail 24.

As shown clearly by FIG. 1, a sliding door 12, when in its lifted-out position, can be displaced past another sliding door 12 that is in its recessed position. In this way, in the case of a plurality of openings 14 disposed next to each other and a plurality of sliding doors 12, a particular sliding door 12 is not assigned in a fixed manner to a particular opening 14. Instead, each sliding door 12 can be used to cover any opening 14.

The invention claimed is:

1. Sliding door system, comprising:

at least one sliding door, which is configured to be slidingly disposed in front of an opening to be covered by the at least one sliding door, the at least one sliding door has an upper sliding-door mount and a lower sliding-door mount, an upper guide rail structured to receive the upper sliding-door mount in a displaceable manner and a lower guide rail structured to receive the lower sliding-door mount in a displaceable manner, which guide rails extend parallel to each other in the longitudinal direction and parallel to the opening, and which each of the guide rails have an inner width that is at least twice as great as the thickness of the sliding door, the upper sliding-door mount and the lower sliding-door mount each being at most half as wide as the inner width of each guide rail, wherein the at least one sliding door is slidingly coupled with the upper and lower guide rails such that it can be moved, perpendicularly in relation to a plane of the opening to be covered, into a recessed position located closer to the opening and into a lifted-out position at a greater distance from the opening, a door position driver structured to provide separate stable states of the door at different positions, the stable states including the recessed position and the lifted-out position wherein the door position driver is also structured to drive a position of the door toward both of the recessed position and the lifted-out position;

a row of first magnets is disposed, respectively, along a center line of the lower guide rail and another row of first magnets is disposed along a center line of the upper guide rail, and a row of second magnets is disposed, respectively, in the lower sliding-door mount and another row of second magnets is disposed in the upper sliding-door mount, such that repelling forces act between the row of first magnets and the row of second magnets, wherein the recessed position and the lifted-out position each constituting a stable state of the sliding door, from which the sliding door can be moved into the respectively other stable state after a defined resistance force produced from the door position driver and acting transversely in relation to the direction of displacement has been overcome.

2. Sliding door system according to claim 1, wherein the magnets are permanent magnets.

3. Sliding door system according to claims 1, wherein the magnets are electrically controlled coil magnets.

4. Sliding door system according to claim 1, wherein a plurality of openings to be covered are disposed next to each other in a row, the upper guide rail and the lower guide rail each extend along the entirety of all openings to be covered, and a plurality of sliding doors for covering a plurality of openings or all openings are received in a displaceable manner in the guide rails.

5. Sliding door system according to claim 4, wherein each sliding door is adapted to be displaced freely along the entire extent of the upper and lower guide rails.

6. Sliding door system according to claim 4, wherein the upper guide rail and the lower guide rail are each composed of a plurality of guide rails that adjoin each other.

7. Sliding door system according to claim 1, wherein each sliding door is adapted to be locked in its recessed position.

8. Sliding door system according to claim 1, wherein the at least one sliding door is structured to be freely slidable in both the recessed and the lifted-out position.

9. Sliding door system, comprising:

at least one sliding door, which is configured to be slidingly disposed in front of an opening to be covered by the at least one sliding door, the at least one sliding door has an upper sliding-door mount and a lower sliding-door mount, an upper guide rail structured to receive the upper sliding-door mount in a displaceable manner and a lower guide rail structured to receive the lower sliding-door mount in a displaceable manner, which guide rails extend parallel to each other in the longitudinal direction and parallel to the opening, and which each of the guide rails have an inner width that is at least twice as great as the thickness of the sliding door, the upper sliding-door mount and the lower sliding-door mount each being at most half as wide as the inner width of each guide rail, wherein the at least one sliding door is slidingly coupled with the upper and lower guide rails such that it can be moved, perpendicularly in relation to a plane of the opening to be covered, into a recessed position located closer to the opening and into a lifted-out position at a greater distance from the opening, a door position driver structured to provide separate stable states of the door at different positions, the stable states including the recessed position and the lifted-out position wherein the door position driver is also structured to drive a position of the door toward both of the recessed position and the lifted-out position;

a row of first magnets is disposed along a center line of the lower guide rail, a row of second magnets is disposed in the lower sliding-door mount, such that repelling forces act between the row of first magnets and the row of second magnets, along the upper guide rail, a first row of third magnets is disposed at locations that are adjacent to the upper sliding-door mount when the sliding door is in the recessed position, and a second row of third magnets is disposed at locations that are adjacent to the upper sliding-door mount when the sliding door is in the lifted-out position, and a row of second magnets is disposed in the upper sliding-door mount, such that forces of attraction act between the rows of third magnets and the row of second magnets wherein the recessed position and the lifted-out position each constituting a stable state of the sliding door, from which the sliding door can be moved into the respectively other stable state after a defined resistance force produced from the door position driver and acting transversely in relation to the direction of displacement has been overcome.

10. Sliding door system according to claim 9, wherein the magnets are permanent magnets.

11. Sliding door system according to claim 9, wherein the magnets are electrically controlled coil magnets.

12. Sliding door system according to claim 9, wherein a plurality of openings to be covered are disposed next to each other in a row, the upper guide rail and the lower guide rail each extend along the entirety of all openings to be covered, and a plurality of sliding doors for covering a plurality of openings or all openings are received in a displaceable manner in the guide rails.

13. Sliding door system according to claim 12, wherein each sliding door is adapted to be displaced freely along the entire extent of the upper and lower guide rails.

14. Sliding door system according to claim 12, wherein the upper guide rail and the lower guide rail are each composed of a plurality of guide rails that adjoin each other.

15. Sliding door system according to claim 9, wherein each sliding door is adapted to be locked in its recessed position.

16. Sliding door system according to claim 9, wherein the at least one sliding door is structured to be freely slidable in both the recessed and the lifted-out position.

17. Sliding door system, comprising:

at least one sliding door, which is configured to be slidingly disposed in front of an opening to be covered by the at least one sliding door, the at least one sliding door has an upper sliding-door mount and a lower sliding-door mount, an upper guide rail structured to receive the upper sliding-door mount in a displaceable manner and a lower guide rail structured to receive the lower sliding-door mount in a displaceable manner, which guide rails extend parallel to each other in the longitudinal direction and parallel to the opening, and which each of the guide rails have an inner width that is at least twice as great as the thickness of the sliding door, the upper sliding-door mount and the lower sliding-door mount each being at most half as wide as the inner width of each guide rail, wherein the at least one sliding door is slidingly coupled with the upper and lower guide rails such that it can be moved, perpendicularly in relation to a plane of the opening to be covered, into a recessed position located closer to the opening and into a lifted-out position at a greater distance from the opening, a door position driver structured to provide separate stable states of the door at different positions, the stable states including the recessed position and the lifted-out position wherein the door position driver is also structured to drive a position of the door toward both of the recessed position and the lifted-out position;

a first row of first magnets is disposed, respectively, along the lower guide rail and another first row of first magnets is disposed in the upper guide rail, at locations that are adjacent to the lower sliding-door mount and the upper sliding-door mount, respectively, when the sliding door is in the recessed position, and a second row of first magnets is disposed at locations that are adjacent to the lower sliding-door mount and the upper sliding-door mount, respectively, when the sliding door is in the lifted-out position, and a row of second magnets is disposed, respectively, in the lower sliding-door mount and the upper sliding-door mount, such that forces of attraction act between the rows of first magnets and the row of second magnets wherein the recessed position and the lifted-out position each constituting a stable state of the sliding door, from which the sliding door can be moved into the respectively other stable state after a defined resistance force produced from the door position driver and acting transversely in relation to the direction of displacement has been overcome.

18. Sliding door system according to claim 17, wherein the lower guide rail and the upper guide rail have a U-shaped cross-section, having two limbs, of which one limb is adjacent to the plane of the opening to be covered, and one limb is at a greater distance from the plane of the opening to be covered, each first row of first magnets is disposed along the limb that is adjacent to the plane of the opening to be covered, and each second row of first magnets is disposed along the limb that is at a greater distance from the plane of the opening to be covered, and the first magnets are electrically controlled coil magnets that are reversible in their polarity.

19. Sliding door system according to claim 17, wherein the magnets are permanent magnets.

20. Sliding door system according to claims 17, wherein the magnets are electrically controlled coil magnets.

21. Sliding door system according to claim 17, wherein a plurality of openings to be covered are disposed next to each other in a row, the upper guide rail and the lower guide rail each extend along the entirety of all openings to be covered, and a plurality of sliding doors for covering a plurality of openings or all openings are received in a displaceable manner in the guide rails.

22. Sliding door system according to claim 21, wherein each sliding door is adapted to be displaced freely along the entire extent of the upper and lower guide rails.

23. Sliding door system according to claim 21, wherein the upper guide rail and the lower guide rail are each composed of a plurality of guide rails that adjoin each other.

24. Sliding door system according to claim 17, wherein each sliding door is adapted to be locked in its recessed position.

25. Sliding door system according to claim 17, wherein the at least one sliding door is structured to be freely slidable in both the recessed and the lifted-out position.

* * * * *